US009914040B2

(12) United States Patent
Carter

(10) Patent No.: US 9,914,040 B2
(45) **Date of Patent: *Mar. 13, 2018**

(54) VERTICAL IMPACT ALIGNMENT AID FOR GOLF CLUB HEADS

(71) Applicant: Callaway Golf Company, Carlsbad, CA (US)

(72) Inventor: Brett Carter, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/620,641

(22) Filed: Jun. 12, 2017

(65) Prior Publication Data

US 2017/0274263 A1 Sep. 28, 2017

Related U.S. Application Data

(63) Continuation of application No. 15/210,714, filed on Jul. 14, 2016, now Pat. No. 9,675,864.

(60) Provisional application No. 62/199,882, filed on Jul. 31, 2015.

(51) Int. Cl.

| | |
|---|---|
| ***A63B 69/36*** | (2006.01) |
| ***A63B 53/00*** | (2015.01) |
| ***A63B 53/04*** | (2015.01) |

(52) U.S. Cl.

CPC ..... *A63B 69/3685* (2013.01); *A63B 53/007* (2013.01); *A63B 53/0487* (2013.01); *A63B 2053/0441* (2013.01)

(58) Field of Classification Search

CPC ..... A63B 69/3685; A63B 53/007; A63B 53/0487; A63B 2053/0441

USPC ..... 473/324–350, 287–292, 219–256

See application file for complete search history.

(56) References Cited

U.S. PATENT DOCUMENTS

| | | | | | |
|---|---|---|---|---|---|
| 3,384,376 | A * | 5/1968 | Greenlee | A63B 69/3685 | 473/236 |
| 4,832,344 | A * | 5/1989 | Werner | A63B 53/065 | 473/244 |
| 5,160,142 | A * | 11/1992 | Marshall | A63B 69/3685 | 473/241 |
| 5,240,253 | A * | 8/1993 | Cooper | A63B 69/3685 | 473/236 |
| 5,429,356 | A * | 7/1995 | Dingle | A63B 53/02 | 473/251 |
| 5,447,313 | A * | 9/1995 | Finley | A63B 69/3685 | 473/244 |
| 5,462,279 | A * | 10/1995 | Culpepper | A63B 53/065 | 473/248 |

(Continued)

OTHER PUBLICATIONS

First Look: Cleveland Golf's TFI 2135 Putters. [online]. [retrieved on Aug. 11, 2015]. Retrieved from the Internet: <URL: http://www.mygolfspy.com/first-look-cleveland-golfs-tfi-2135-putters/>.

*Primary Examiner* — Sebastiano Passaniti
(74) *Attorney, Agent, or Firm* — Michael Catania; Rebecca Hanovice; Sonia Lari

(57) ABSTRACT

A golf club head, and particularly a putter head, comprising at least one visual reference point that shows a golfer the ideal vertical impact height at address and at impact is disclosed herein. The visual reference preferably is an alignment aid, such as an alignment pin or bar, which delineates the vertical center of the face between the top and bottom portions of the golf club head along the vertical z axis.

16 Claims, 13 Drawing Sheets

(56) References Cited

U.S. PATENT DOCUMENTS

| | | | | |
|---|---|---|---|---|
| 5,709,611 | A * | 1/1998 | Intag | A63B 69/3685 473/236 |
| 7,341,526 | B2 | 3/2008 | McCarthy | |
| 9,675,864 | B1 * | 6/2017 | Carter | A63B 69/3685 |
| 2005/0202895 | A1 * | 9/2005 | Hueber | A63B 53/0487 473/252 |
| 2017/0036077 | A1 * | 2/2017 | Warren | A63B 53/0487 |
| 2017/0282028 | A1 * | 10/2017 | Sheldon | A63B 53/0487 |

* cited by examiner

VERTICAL IMPACT ALIGNMENT AID FOR GOLF CLUB HEADS

CROSS REFERENCES TO RELATED APPLICATIONS

The present application is a continuation of U.S. patent application Ser. No. 15/210,714, filed on Jul. 14, 2016, and issued on Jun. 13, 2017, as U.S. Pat. No. 9,675,864, which claims priority to U.S. Provisional Patent Application No. 62/199,882, filed on Jul. 31, 2015, the disclosure of which is hereby incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a golf club head, particularly a putter, with one or more alignment features that are vertically centered on a back surface of the head opposite the striking face.

Description of the Related Art

The prior art discloses many different types of alignment aids disposed on golf club heads, and on putters in particular. In fact, nearly all putters in the marketplace include some form of horizontal alignment aid, usually in the form of a paint-filled feature on the topline of the putter head, which is circled on the prior art putter shown in FIG. 1. These alignment aids are intended to give golfers a visual reference or gauge for the putter's face center along a horizontal axis, because ball speed and sidespin noticeably change if a golfer hits a ball with the heel or toe side of the putter face, i.e., a horizontal mishit, instead of with the face center. If a golfer is able to hit a golf ball with the center face of a putter, the distance and roll of the golf ball will be more reliable and predictable.

Similarly, ball speed, backspin, and topspin are all negatively affected if a golfer mishits the golf ball vertically, i.e., above or below the center of the putter face. Unfortunately, the prior art, including U.S. Pat. No. 7,341,526 to McCarthy, does not address this problem or provide optimal results. Therefore, there is a need for a putter alignment system that allows a golfer to vertically align the putter face with a golf ball when taking a shot.

BRIEF SUMMARY OF THE INVENTION

The present invention is directed to a golf club head, and particularly a putter-type head, comprising a striking face, a rear face opposite and parallel to the striking face, and an alignment aid located at a central location on the rear face along a vertical z axis. Providing a vertical alignment aid increases the likelihood that the golfer will hit a golf ball with the vertical center of the putter face, which thereby improves ball launch conditions, impact feel, sound, feedback, and golfer awareness at address.

One aspect of the present invention is a golf club head comprising a body comprising a striking face, a rear surface opposite the striking face, a top portion, a bottom portion, a heel side, and a toe side, and an alignment aid that is at least partially disposed at a first point on the rear surface, wherein the striking face comprises a second point, wherein a z axis extends vertically from the bottom portion to the top portion, wherein a y axis extends horizontally from the heel side to the toe side, wherein an x axis extends horizontally from the striking face to the rear surface, wherein the second point is located at a vertical center of the striking surface between the top portion and the bottom portion along the z axis, and wherein the first point has the same location on the z axis as the second point. In some embodiments, the second point may be located at a horizontal center of the striking surface between the heel side and the toe side along the y axis, and the first point may have the same location on the y axis as the second point.

In other embodiments, the golf club head may be a putter head, the alignment aid may be an alignment pin, and the alignment pin may extend away from the rear surface along the x axis. In a further embodiment, the top portion may comprise a top surface, the top portion may be at least partially composed of a translucent material, the alignment pin may extend through the rear surface towards the striking face along the x axis, and the alignment pin may be visible through the top surface. In still other embodiments, the alignment pin may comprise a hollow, cylindrical cross section. In another embodiment, the alignment pin may comprise a cross-shaped cross section having a vertical prong and a horizontal prong, the vertical prong may extend along an xz plane extending through a horizontal center of the striking surface, and the horizontal prong may extend along an xy plane extending through the vertical center of the striking surface. In any of these embodiments, the alignment pin may have a first depth, the body may have a second depth, and the first depth may be less than the second depth. In any of the embodiments, the body may be composed of a metal material and the alignment aid may be composed of a non-metal material.

In an alternative embodiment, the golf club head may be a putter head, the alignment aid may be an alignment bar that extends away from the rear surface along an xy plane extending through the vertical center of the striking surface, the alignment bar may have a first width, the body may have a second width, and the first width may be greater than the second width. In a further embodiment, the alignment bar may have a first depth, the body may have a second depth, and the first depth may be less than the second depth.

Another aspect of the present invention is a putter head comprising a body comprising a striking face, a rear surface opposite the striking face, a top surface, a sole flange having a bottom surface and an upper surface, a heel side, and a toe side, and at least one raised feature, wherein a z axis extends vertically from the bottom surface to the top surface, wherein a y axis extends horizontally from the heel side to the toe side, wherein an x axis extends horizontally from the striking face to the rear surface, wherein the striking face comprises a center point located at a vertical center of the striking surface between the top surface and bottom surface along the z axis, wherein the at least one raised feature extends vertically from the upper surface of the sole flange, wherein the at least one raised feature comprises an uppermost edge extending away from the rear surface along the x axis, and wherein the uppermost edge has the same location on the z axis as the center point. In some embodiments, the uppermost edge may comprise a paint-filled alignment line, and may be disposed at a horizontal center of the rear surface between the heel side and the toe side along the y axis.

In some embodiments, the at least one raised feature may comprise a central raised feature having a first uppermost edge, a heel-side raised feature, and a toe-side raised feature, the central raised feature may be separated from the heel-side raised feature by a first recessed area and from the toe-side raised feature by a second recessed area, and the first uppermost edge may be disposed at a horizontal center of the rear surface between the heel side and the toe side along the y axis. In a further embodiment, at least a portion of the central, heel-side, and toe-side raised areas are painted a first color, and the first and second recessed areas may be painted a second color that contrasts with the first color. In yet another, further embodiment, a top half of the rear surface may be painted the first color and a bottom half of the rear surface may be painted the second color.

Yet another aspect of the present invention is a putter head comprising a striking face, a rear surface opposite the striking face, a top surface, a sole flange comprising a bottom surface and an upper surface, a heel side, and a toe side, wherein a z axis extends vertically from the bottom surface to the top surface, wherein a y axis extends horizontally from the heel side to the toe side, wherein an x axis extends horizontally from the striking face to the rear surface, wherein the striking face comprises a center point located at a vertical center of the striking surface between the top surface and the bottom surface along the z axis, wherein the rear surface comprises an upper half comprising a first color and a lower half comprising a second color, wherein the first color contrasts with the second color, and wherein an interface between the first and second colors has the same location on the z axis as the center point. In some embodiments, the upper surface may comprise at least one alignment line, which may extend perpendicular to the rear surface along an xz plane that intersects the center point. In other embodiments, the putter head may comprise an alignment pin, which may be disposed at the interface and extend perpendicular to the rear surface along an xz plane that intersects the center point. In still other embodiments, the first color may be black and the second color may be white.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

The present invention is directed to a golf club head, and particularly a putter, having an alignment aid that is centrally located, along a vertical z axis, along a vertical surface directly opposite the face and is visible at both address and during a stroke. The inventor has determined that vertically centering an alignment aid on the back face improves golfers' vertical impact height, face angle at address, and horizontal address position when putting. A statistically significant improvement in putting control was observed upon the addition of vertical alignment aids to test subjects' putters, which illustrates the importance of vertical impact height consistency in making putts. The novel vertical alignment aids disclosed herein provide golfers with an additional visual reference that they can use to putt more consistently.

Figure 1:
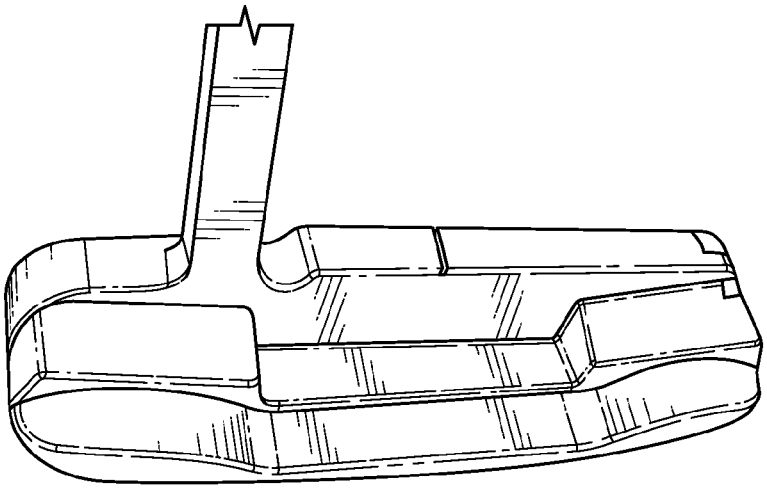
FIG. 1 (Prior Art)
FIG. 1 is a top perspective view of a prior art putter head.
Figure 2:
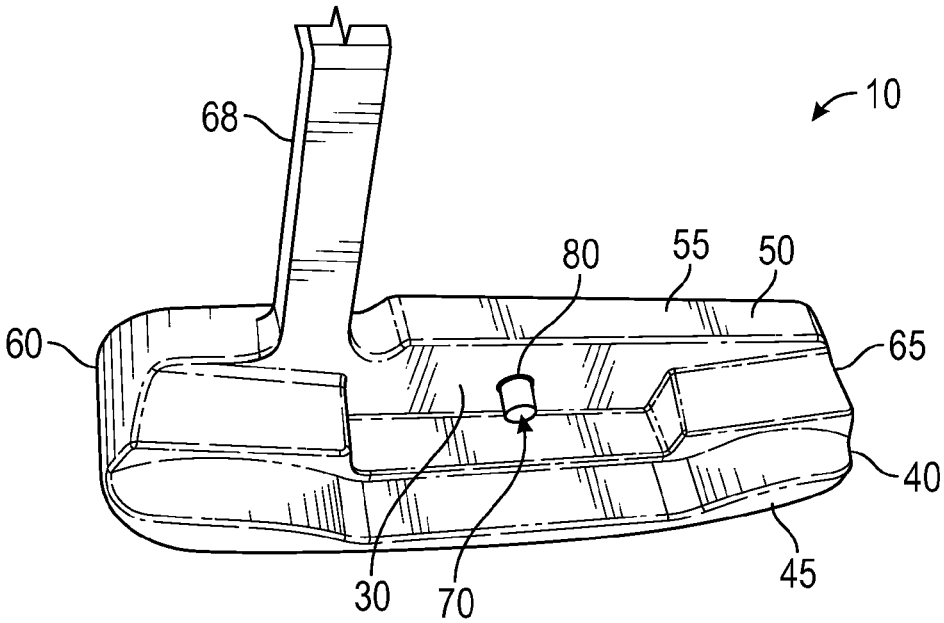
FIG. 2 is a top perspective view of a first embodiment of the present invention.

In a first, preferred embodiment, shown in FIG. 2, the putter head 10 has a striking face 20, a rear surface 30 opposite to, and parallel with, the striking face 20, a sole portion 40 with a leading edge 49 at the bottom of the striking face 20, a bottom surface 45, a top portion 50 with a top surface 55, a heel edge 60, a toe edge 65, a hosel 68, and an alignment pin 70. The alignment pin 70, which may have any cross-sectional shape (e.g., circular, square, triangular, rectangular, pentagonal, hexagonal, octagonal), is disposed at a location 80 on the rear surface 30 that is centered both vertically between the top surface 55 of the top portion 50 and bottom surface 45 of the sole portion 40, and horizontally between the heel edge 60 and the toe edge 65. This location 80 on the rear surface 30 corresponds with a center 25, both vertically and horizontally, of the striking face 20. The sole portion 40 preferably is a flange that extends perpendicularly rearward from the rear surface 30 and is significantly thinner than the maximum height H of the putter head 10.

Figure 3:
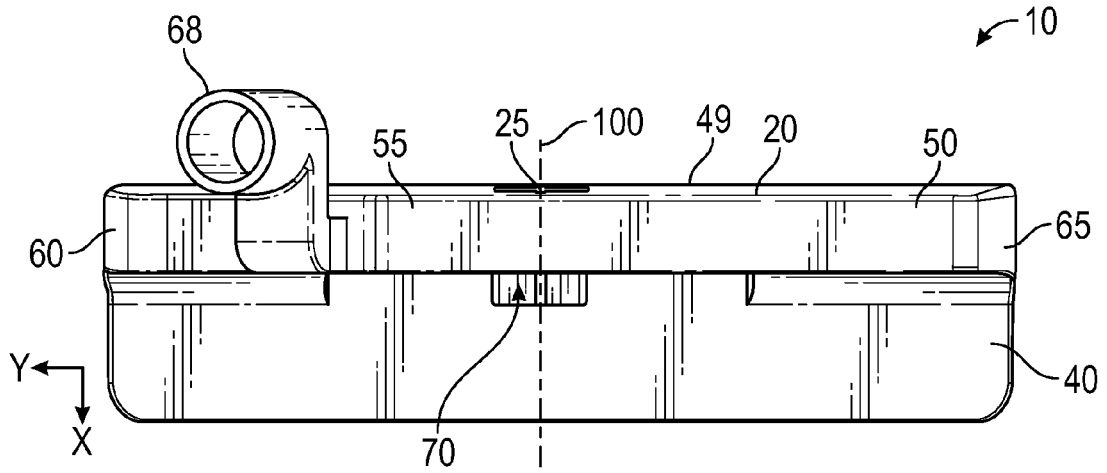
FIG. 3 is a top plan view of a second embodiment of the present invention.
Figure 4:
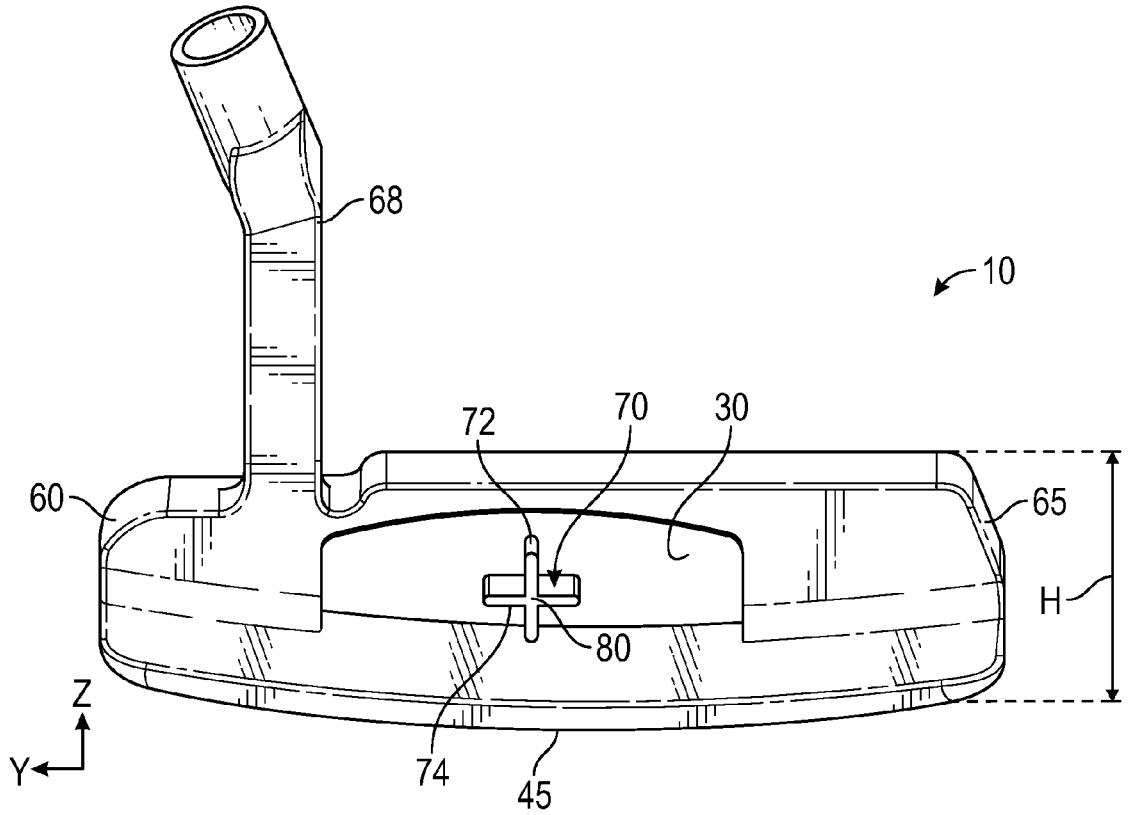
FIG. 4 is a rear elevational view of the embodiment shown in FIG. 3.

In a second embodiment, shown in FIGS. 3 and 4, the putter head 10 has all of the same elements as the preferred embodiment, except that the alignment pin 70 has a cross-shaped cross-section, with a vertical prong 72 that extends from a location proximate the sole portion 40 to a location proximate the top portion 50 and a horizontal prong 74 that has the same length as the vertical prong 72. The vertical prong 72 is located at a horizontal center of the rear surface 30, while the horizontal prong 74 is located at a vertical center of the rear surface 30.

Figure 5:
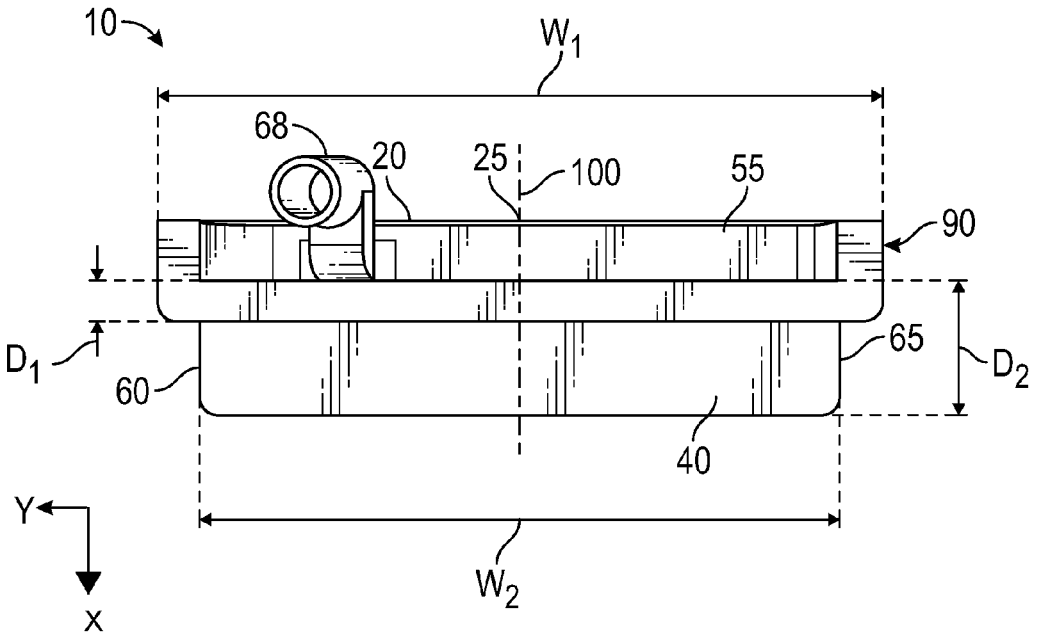
FIG. 5 is a top plan view of a third embodiment of the present invention.
Figure 6:
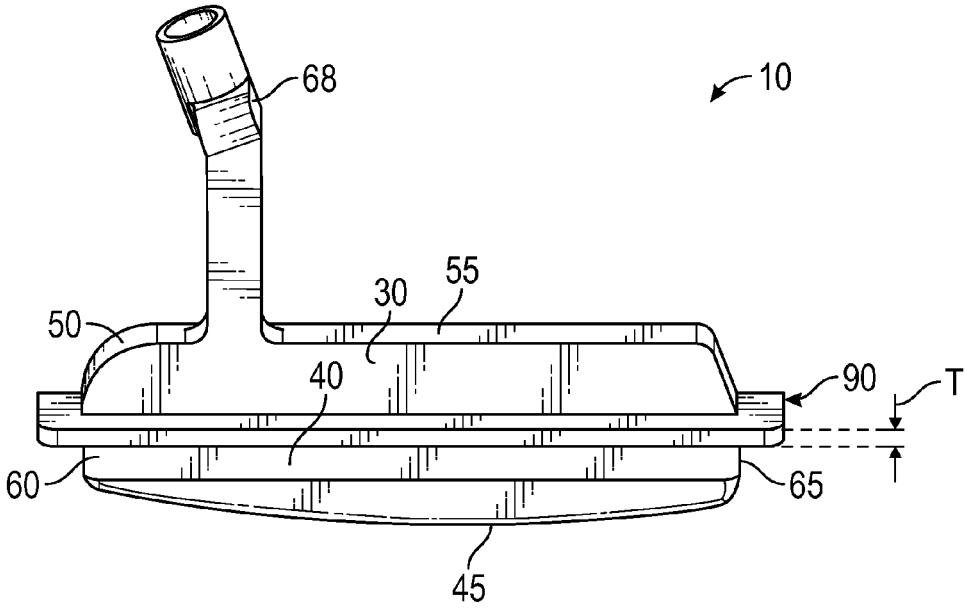
FIG. 6 is a rear elevational view of the embodiment shown in FIG. 5.
Figure 7:
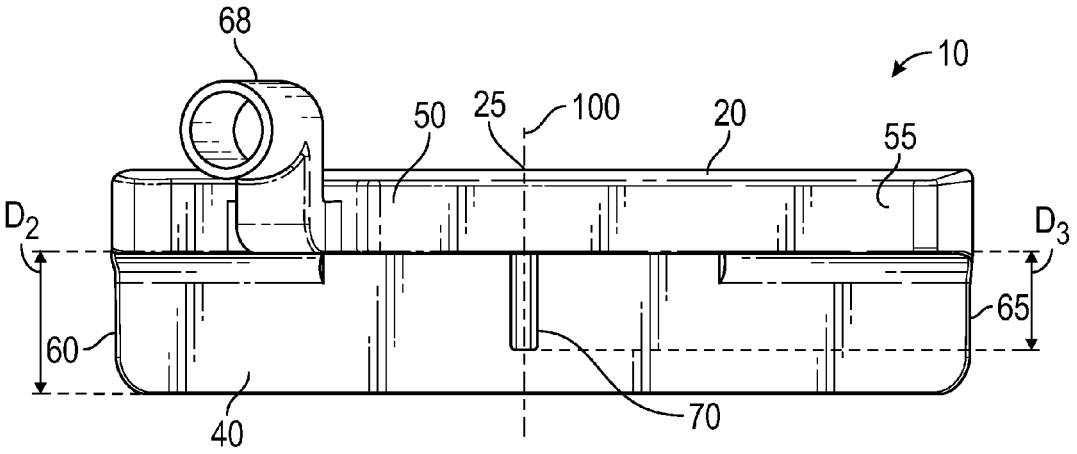
FIG. 7 is a top plan view of a fourth embodiment of the present invention.

In a third embodiment, shown in FIGS. 5 and 6, the putter head 10 has a 180° alignment bar 90 instead of an alignment pin 70 with a maximum width $W_1$ that is greater than the maximum width $W_2$ of the putter head 10. Preferably, most of the alignment bar 90 is centrally located between the top surface 55 and the bottom surface 45 along a vertical z axis. The alignment bar 90 preferably has a thickness T that is less than its depth $D_1$ (measured from the rear surface 30), and its depth $D_1$ is preferably less than the overall depth $D_2$ of the sole portion 40.

Figure 8A:
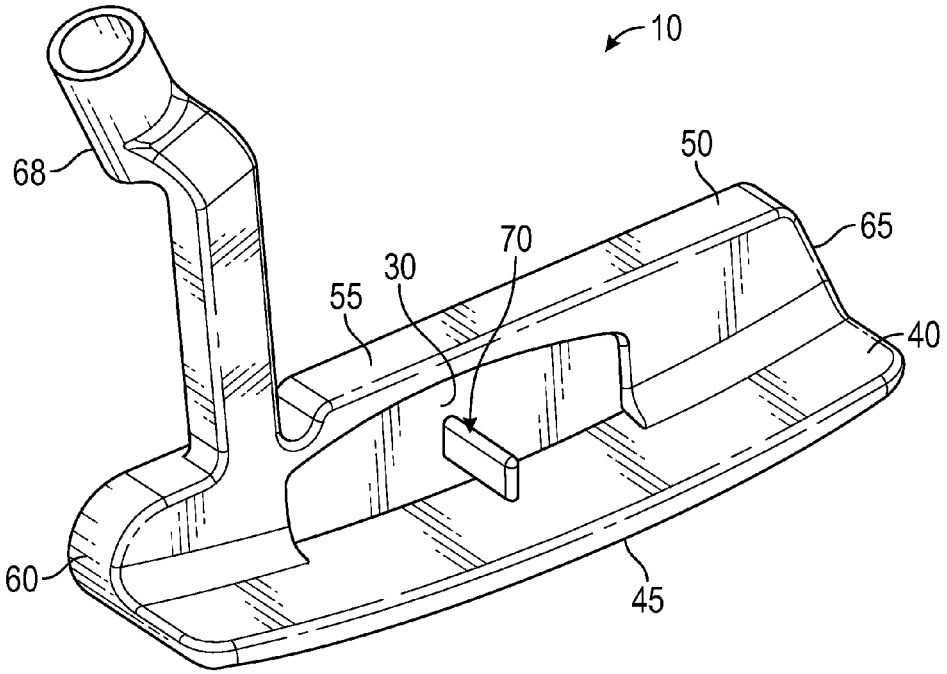
FIGS. 8A-8E are views of five different versions of the embodiment shown in FIG. 7
Figure 8B:
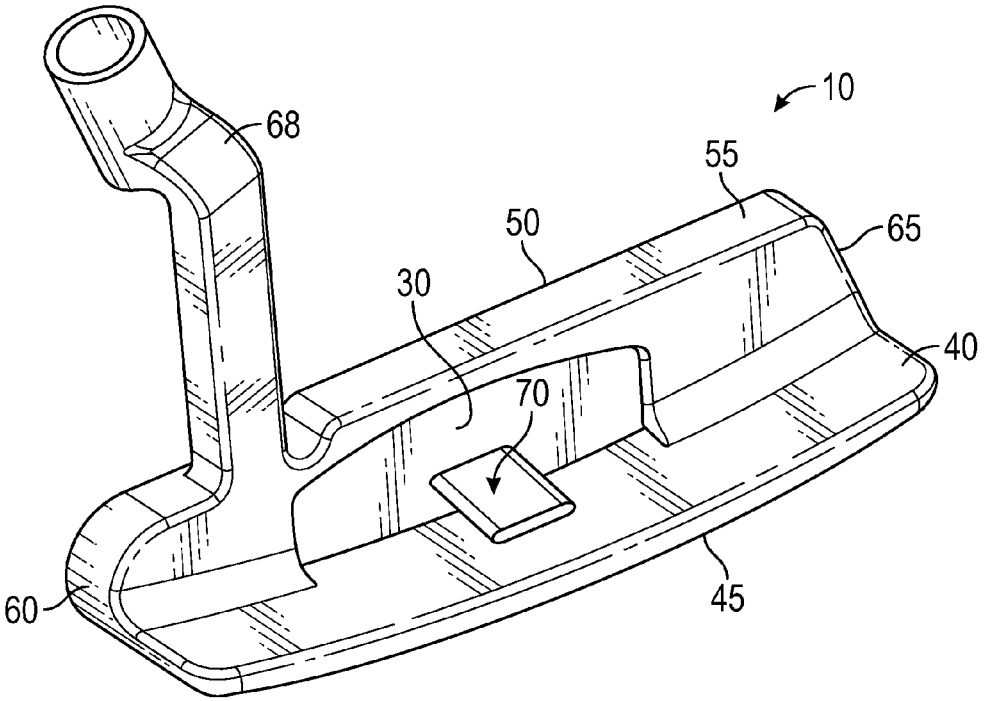
Figure 8C:
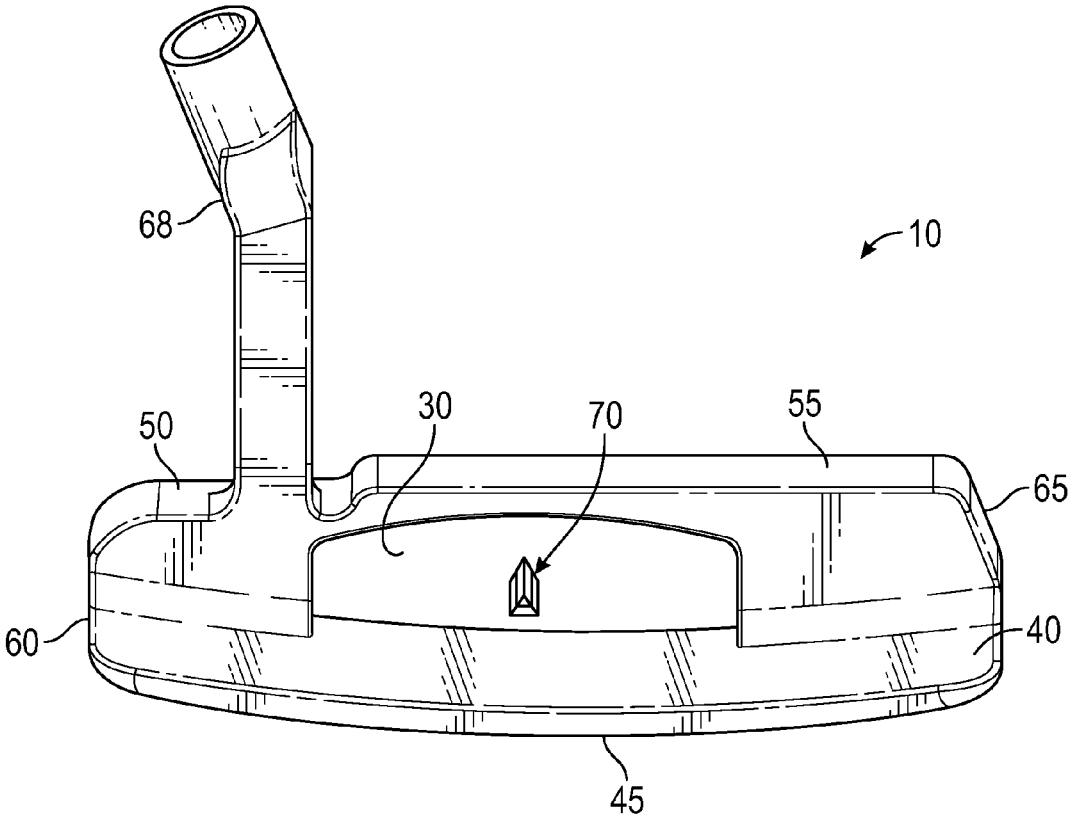
Figure 8D:
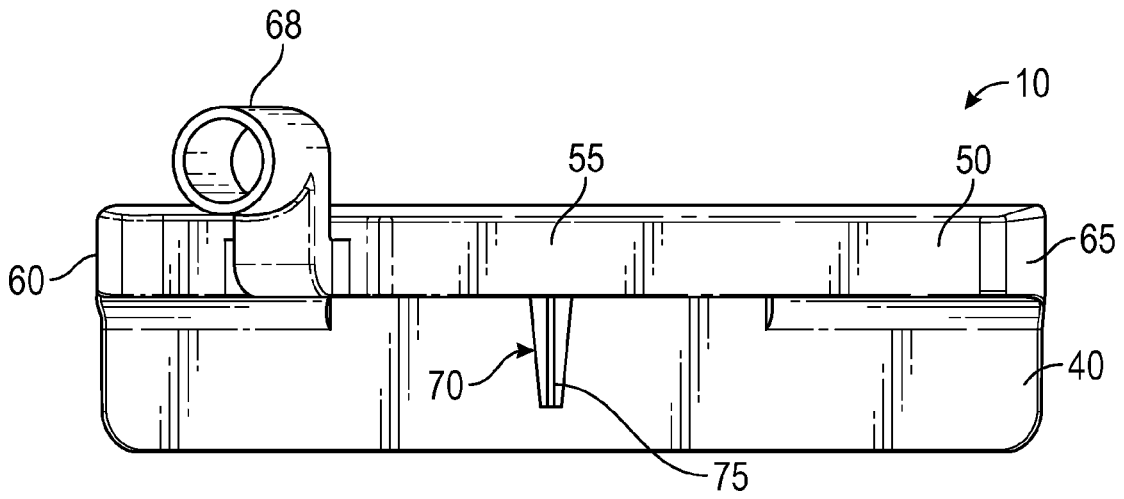
Figure 8E:
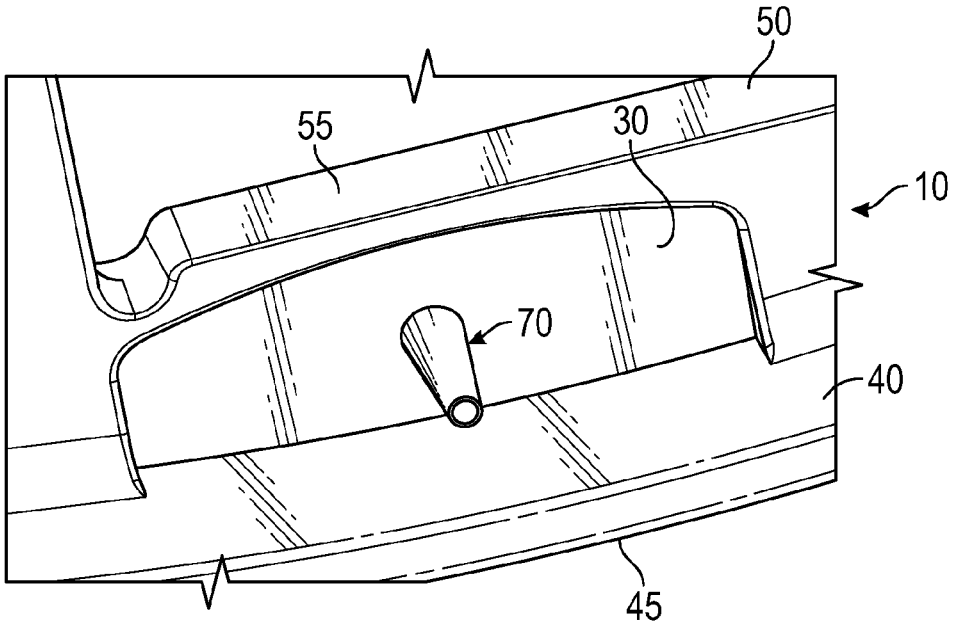
Figure 10:
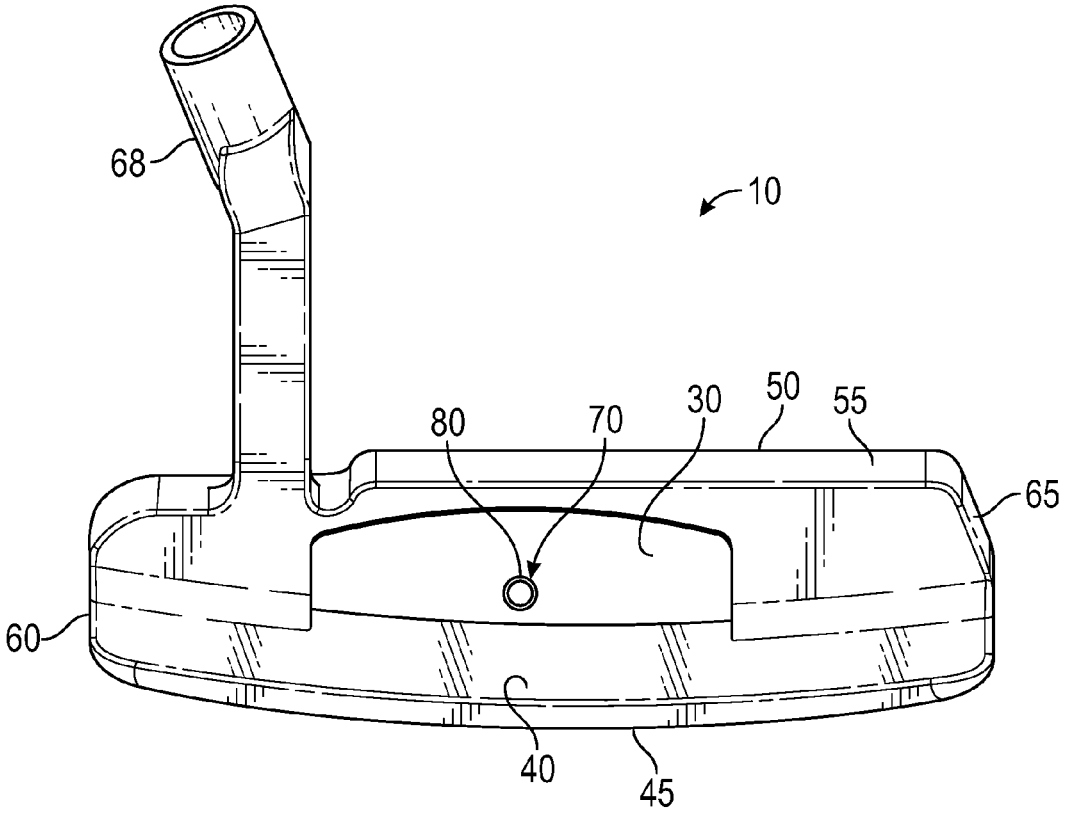
FIG. 10 is a rear elevational view of the embodiment shown in FIG. 9.

In a fourth embodiment, shown in FIGS. 7 and 8A-8E, the alignment pin 70 has a depth $D_3$ that is nearly as great as the depth $D_2$ of the sole portion, and may have any type of cross-sectional shape, including circular like the pin in the embodiment shown in FIGS. 2 and 10, vertically or horizontally oblong (FIGS. 8A and 8B), triangular (FIG. 8C), or conical with or without an upper groove 75 (FIGS. 8D and 8E).

Figure 9:
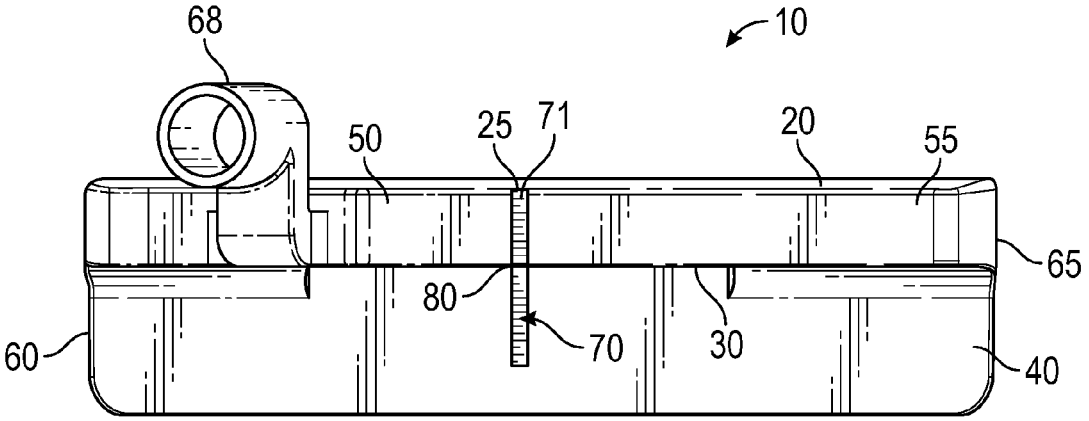
FIG. 9 is a top plan view of a fifth embodiment of the present invention.

In a fifth embodiment, shown in FIGS. 9 and 10, the alignment pin 70 extends through the rear surface 30 and abuts (or, in another embodiment, approaches) the center 25 of the striking face 20, and the top portion 50 is made of a transparent or translucent material so that the entire upper surface 71 of the alignment pin 70 is visible through the top surface 55.

Figure 11:
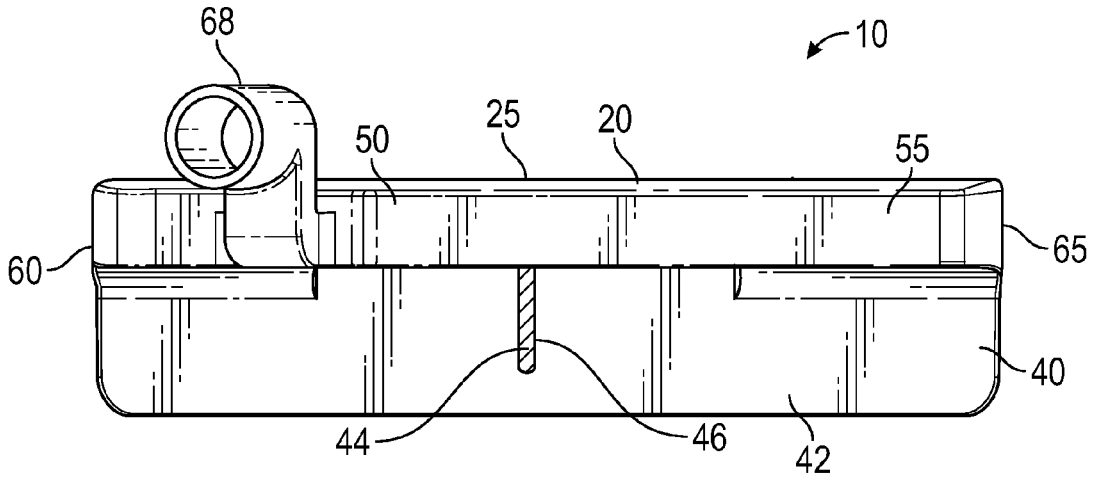
FIG. 11 is a top plan view of a sixth embodiment of the present invention.
Figure 12A:
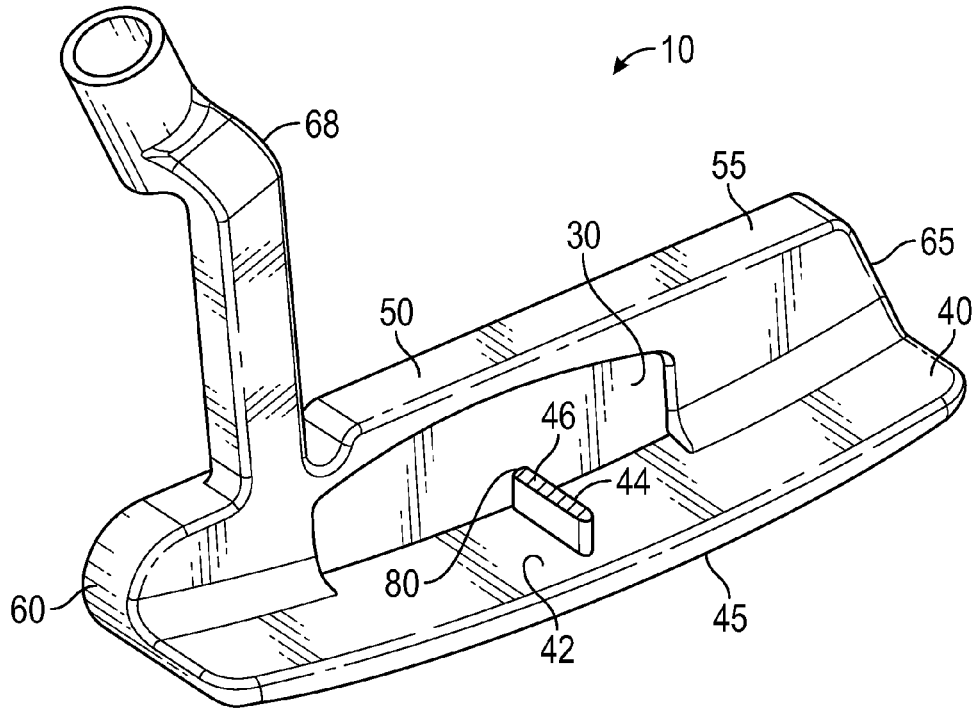
FIGS. 12A and 12B are rear perspective views of two different versions of the embodiment shown in FIG. 11.
Figure 12B:
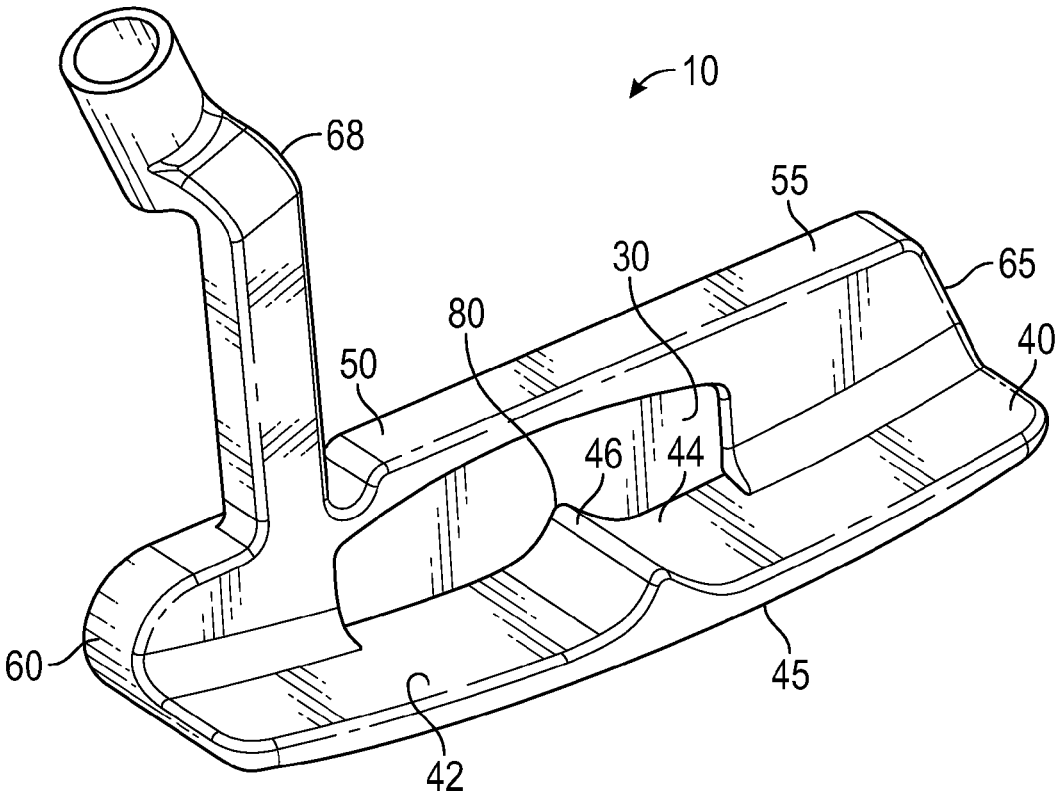

In a sixth embodiment, shown in FIGS. 11, 12A, and 12B, the alignment aid is affixed to or created by the sole portion 40, which has an upper surface 42 with a raised feature 44 that extends vertically up to the location 80 on the rear surface 30 opposite the striking face 20 center 25. The raised feature 44 can add mass to the putter head 10 if that is desired by the golfer, and can have an aesthetically pleasing shape. Two options for this raised feature 44 (a rectangular bar and a gently sloping ridge) are shown in FIGS. 12A and 12B. The raised feature 44 can be painted a different color than other parts of the putter head 10, and may include a paint-filled alignment line 46 on its upper surface.

Figure 13:
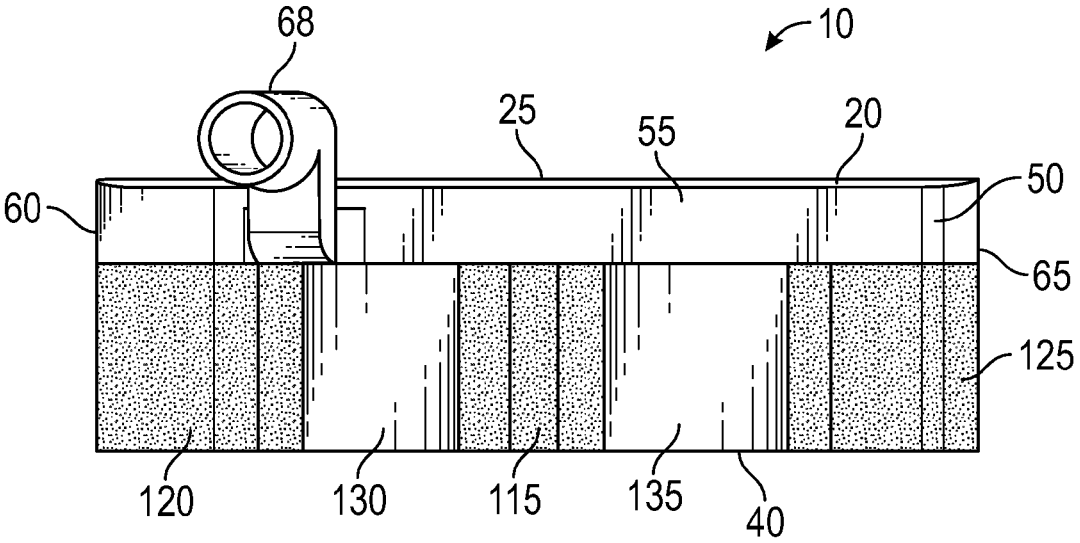
FIG. 13 is a top plan view of a seventh embodiment of the present invention.
Figure 14:
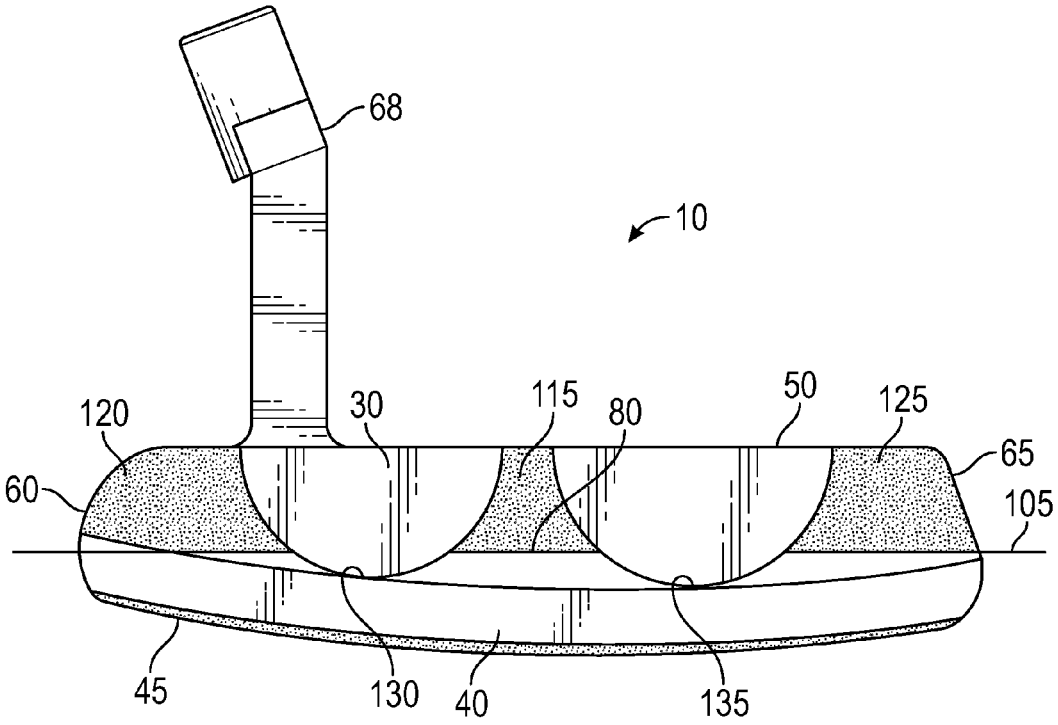
FIG. 14 is a rear plan view of the embodiment shown in FIG. 13.
Figure 15:
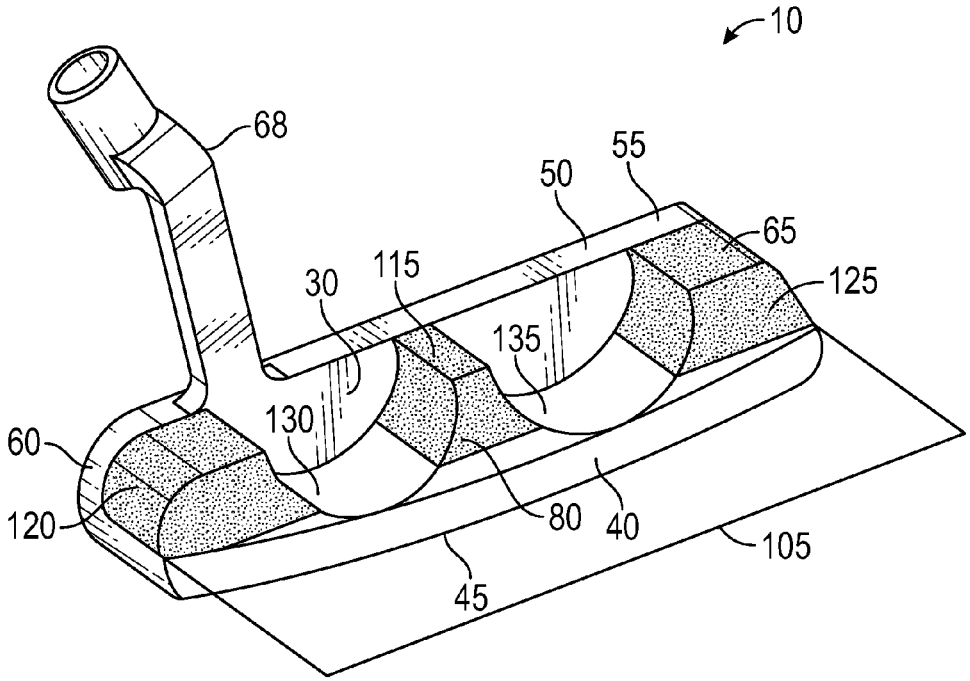
FIG. 15 is a side perspective view of the embodiment shown in FIG. 13.
Figure 16:
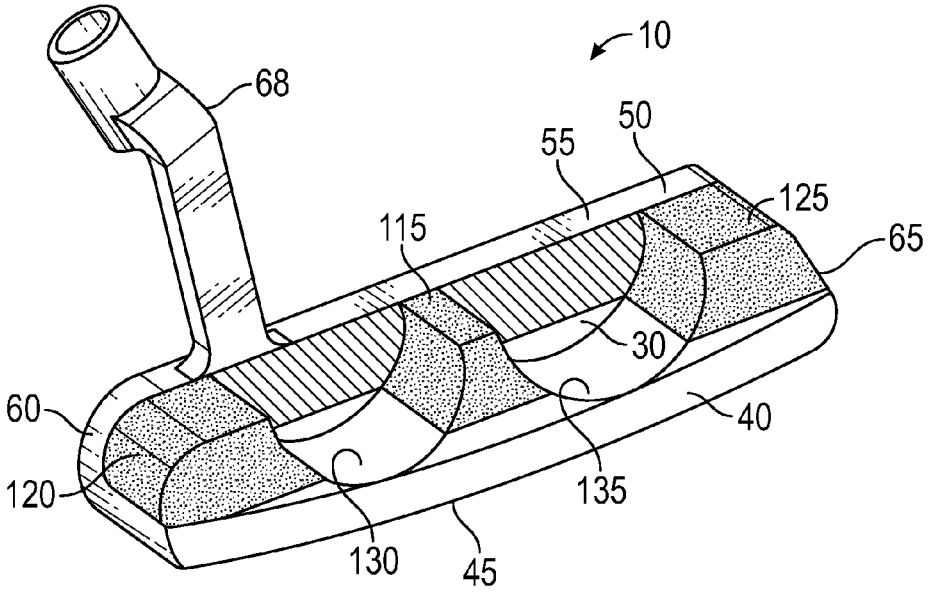
FIG. 16 is a side perspective view of an alternative embodiment of the putter head shown in FIG. 13.
Figure 17:
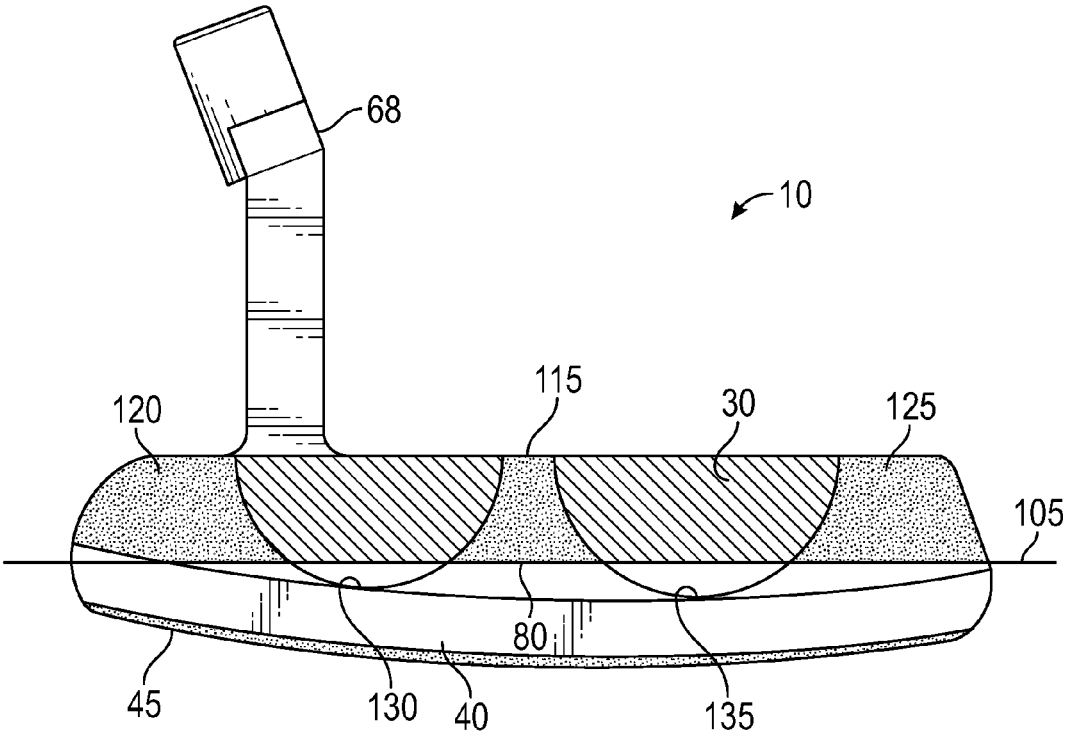
FIG. 17 is a rear plan view of the embodiment shown in FIG. 16.

In a seventh embodiment, shown in FIGS. 13-15, the upper surface 42 of the sole portion 40 includes multiple raised features 115, 120, 125 painted in one or more colors that contrast with recessed areas 130, 135 of the sole portion 40. The centered raised feature 115 is flanked by a heel-side raised feature 120 and a toe-side raised feature 125, all of which are painted black, and these three raised features 115, 120, 125 are separated from one another by a pair of recessed areas 130, 135, which are painted white. As shown in FIGS. 14 and 15, the colors terminate at a horizontal xy plane 105 extending through the location 80 on the rear surface 30 opposite the center 25 of the striking face 20. In an alternative embodiment, the rear surface 30 may also be painted the contrasting colors to provide visual continuity for the various alignment features when the putter head 10 is viewed from the rear, as shown in FIGS. 16 and 17.

Figure 18:
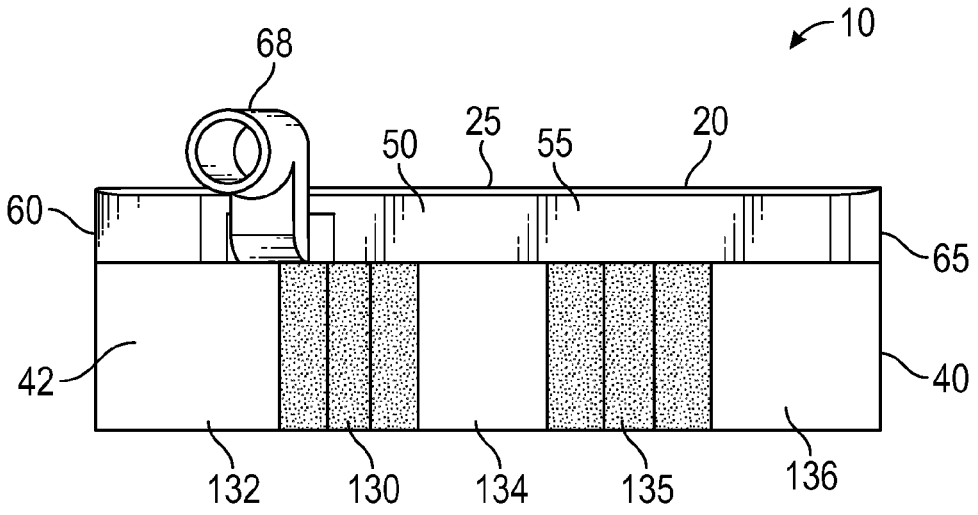
FIG. 18 is a top plan view of an eighth embodiment of the present invention.
Figure 19:
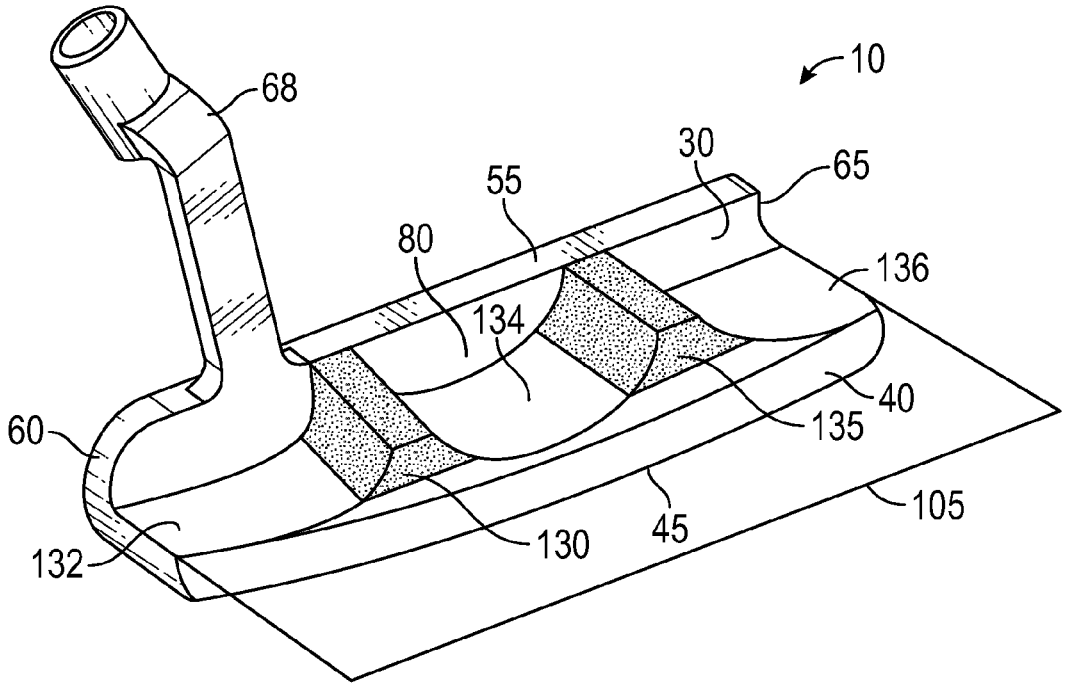
FIG. 19 is a rear perspective view of the embodiment shown in FIG. 18.

In an eighth embodiment, shown in FIGS. 18 and 19, the upper surface 42 of the sole portion 40 includes a different pattern of raised features 130, 135 that are painted with one or more colors that contrast with their neighboring recessed areas 132, 134, 136 of the sole portion 40. As with the seventh embodiment, the colors terminate at a horizontal xy plane 105 extending through the location 80 on the rear surface 30 opposite the center 25 of the striking face 20. In an alternative embodiment, the rear surface 30 may also be painted the contrasting colors to provide visual continuity for the various alignment features when the putter head 10 is viewed from the rear.

Figure 20:
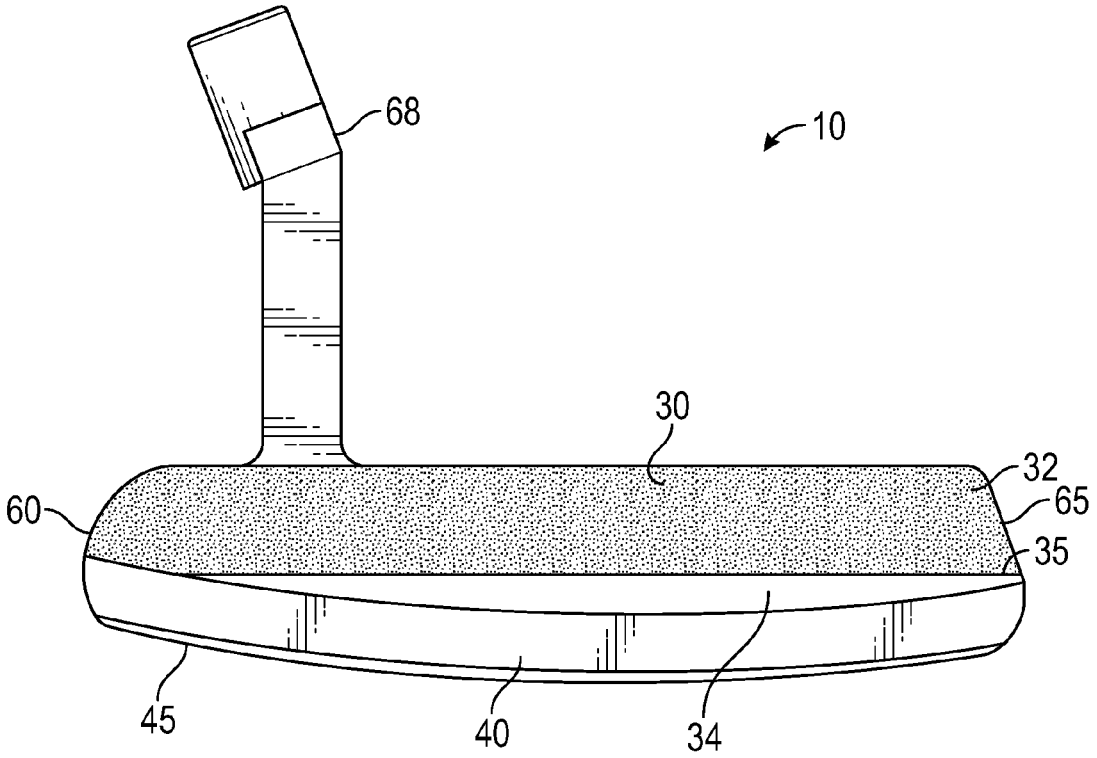
FIG. 20 is a rear plan view of a ninth embodiment of the present invention.
Figure 21:
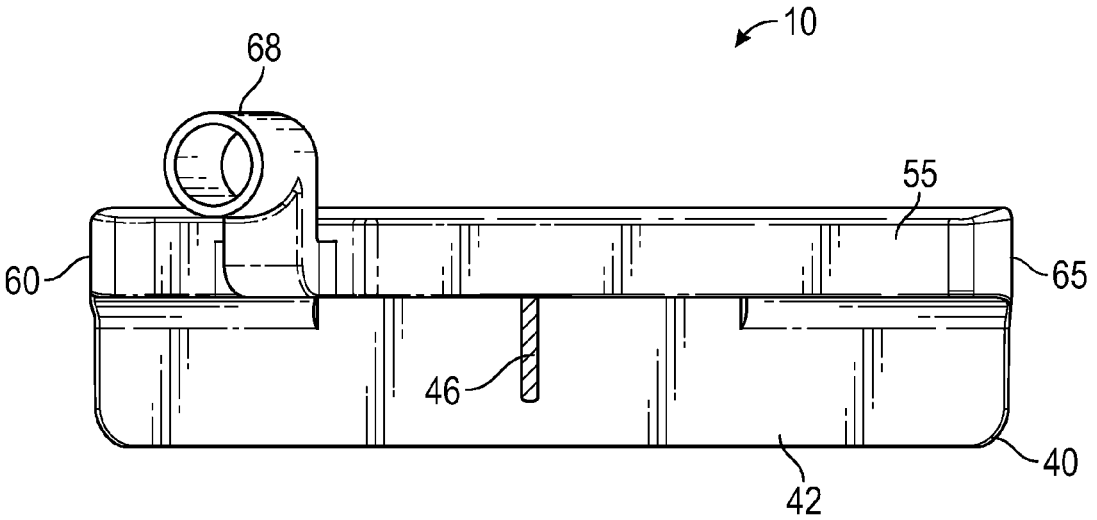
FIG. 21 is a top plan view of the embodiment shown in FIG. 20.

In a ninth embodiment, shown in FIGS. 20 and 21, the contrasting paint provides the vertical alignment aid instead of physical structures. In particular, the top surface 55 of the top portion 50 is painted a dark color, the top half 32 of the rear surface 30 is painted the same dark color, and the bottom half 34 of the rear surface 30 is painted a contrasting, lighter color. The interface 35 of the contrasting colors provides the vertical alignment aid of the present invention. The horizontal center of the striking face 20 can be indicated using an alignment pin 70 or paint-filled alignment line 46 extending across the upper surface 42 of the sole portion 40. The putter head 10 may also include curved sighting lines painted on the rear surface to further help a golfer align the putter with a golf ball at address.

As shown in these embodiments, the alignment aid may extend parallel with or perpendicular to a putting target line 100. In each of the embodiments disclosed herein, the alignment aid is disposed as close to the striking face as possible. More than one of the alignment embodiments disclosed herein can be combined on a single golf club head to ensure that the vertical center location is visible to a golfer.

The alignment pin 70 and alignment bar 90 disclosed herein may be integrally formed with the putter head 10, but preferably are formed from a lower density material than the putter head 10 and are permanently or removably fixed to the rear surface 30. The alignment pins 70 and alignment bars 90 disclosed herein may be solid or hollow. Though the alignment aids disclosed herein are shown in connection with putters, they may be incorporated into any type of golf club head, including drivers, fairway woods, irons, hybrids, and wedges. In an alternative embodiment, any of the alignment aids disclosed herein may be disposed at a point that corresponds to the putter head 10 center of gravity, or at least the vertical height of the center of gravity along the vertical z axis.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim:

1. A putter head comprising:

a body comprising a striking face, a rear surface opposite the striking face, a top portion, a bottom portion, a heel side, and a toe side; and an alignment pin that is at least partially disposed at a first point on the rear surface, wherein the striking face comprises a second point, wherein a y axis extends horizontally from the heel side to the toe side parallel with the striking face, wherein a z axis extends vertically from the bottom portion to the top portion perpendicular to, and intersecting with, the y axis, wherein an x axis extends horizontally from the striking face to the rear surface perpendicular to, and intersecting with, the z axis and the y axis, wherein the second point is located at a vertical center of the striking surface between the top portion and the bottom portion along the z axis, wherein the second point is located at a horizontal center of the striking surface between the heel side and the toe side along the y axis, wherein the first point corresponds with the second point along the y axis, wherein the first point corresponds with the second point along the z axis, wherein the alignment pin extends away from the rear surface along the x axis, wherein the top portion is composed of a translucent material and comprises a top surface, wherein the alignment pin extends through the rear surface towards the striking face along the x axis, and wherein the alignment pin is visible through the top surface.

2. The putter head of claim 1, wherein the alignment pin comprises a hollow cross-section.

3. The putter head of claim 1, wherein the alignment pin comprises a circular cross-sectional shape.

4. The putter head of claim 1, wherein the alignment pin has a first depth measured along the x axis from the rear surface to a distal end of the alignment pin, wherein the body has a sole portion with a second depth measured along the x axis from the rear surface to a rearmost edge of the body, and wherein the first depth is less than the second depth.

5. The putter head of claim 1, wherein the body is composed of a metal material, and wherein the alignment pin is composed of a non-metal material.

6. The putter head of claim 1, wherein the body comprises a sole flange extending perpendicular from the rear surface, wherein the putter head comprises a first height, wherein the sole flange comprises a second height, and wherein the first height is greater than the second height.

7. A putter head comprising:

a body comprising a striking face, a rear surface opposite the striking face, a top portion, a bottom portion, a heel side, and a toe side; and an alignment pin that is at least partially disposed at a first point on the rear surface, wherein the striking face comprises a second point, wherein a y axis extends horizontally from the heel side to the toe side parallel with the striking face, wherein a z axis extends vertically from the bottom portion to the top portion perpendicular to, and intersecting with, the y axis, wherein an x axis extends horizontally from the striking face to the rear surface perpendicular to, and intersecting with, the z axis and the y axis, wherein the second point is located at a vertical center of the striking surface between the top portion and the bottom portion along the z axis, wherein the second point is located at a horizontal center of the striking surface between the heel side and the toe side along the y axis, wherein the first point corresponds with the second point along the y axis, wherein the first point corresponds with the second point along the z axis, and wherein the alignment pin extends away from the rear surface along the x axis, wherein a top half of the rear surface is painted a first color, wherein a bottom half of the rear surface is painted a second color, and wherein the first color is different from and contrasts with the second color.

8. The putter head of claim 7, wherein the first color is black and the second color is white.

9. A putter head comprising:

a metal body comprising a striking face, a rear surface opposite the striking face, a top portion, a sole flange portion extending perpendicular from the rear surface, a heel side, and a toe side; and an alignment pin that is at least partially disposed at a first point on the rear surface, wherein the striking face comprises a second point, wherein a y axis extends horizontally from the heel side to the toe side parallel with the striking face, wherein a z axis extends vertically from a bottom portion to the top portion perpendicular to, and intersecting with, the y axis, wherein an x axis extends horizontally from the striking face to the rear surface perpendicular to, and intersecting with, the z axis and the y axis, wherein the second point is located at a vertical center of the striking surface between the top portion and the bottom portion along the z axis, wherein the second point is located at a horizontal center of the striking surface between the heel side and the toe side along the y axis, wherein the first point corresponds with the second point along the y axis, wherein the first point corresponds with the second point along the z axis, wherein the sole flange has a thickness measured along the z-axis that is less than a maximum thickness of the body measured along the z axis, wherein the alignment pin extends away from the rear surface along the x axis, wherein the alignment pin has a first depth measured along the x axis from the rear surface to a distal end of the alignment pin, wherein the sole flange has a second depth measured along the x axis from the rear surface to a rearmost edge of the body, wherein the first depth is less than the second depth, and wherein the alignment pin has a circular cross-sectional shape, an upper surface having a groove, and a hollow portion.

10. The putter head of claim 9, wherein the alignment pin is integrally formed with the body.

11. The putter head of claim 9, wherein the body is composed of a first material having a first density, wherein the alignment pin is composed of a second material having a second density, and wherein the second density is less than the first density.

12. The putter head of claim 9, wherein the alignment pin is removably fixed to the rear surface.

13. The putter head of claim 9, wherein the sole flange comprises a flange upper surface, and wherein the flange upper surface comprises a paint filled alignment line.

14. The putter head of claim 9, wherein the rear surface comprises an upper half comprising a first color and a lower half comprising a second color, wherein the first color is different from and contrasts with the second color, and wherein an interface between the first and second colors extends along a horizontal xy plane through the first point.

15. The putter head of claim 14, wherein the first color is black and the second color is white.

16. The putter head of claim 14, wherein a top surface of the top portion comprises the first color.

* * * * *